United States Patent [19]

Yokoe et al.

[11] Patent Number: 4,849,902

[45] Date of Patent: Jul. 18, 1989

[54] STITCH DATA PROCESSING APPARATUS FOR EMBROIDERY SEWING MACHINE

[75] Inventors: Masaaki Yokoe; Yoshikazu Kurono; Kouji Hayashi; Miho Hashimoto, all of Aichi, Japan

[73] Assignee: Brother Kogyo Kabushiki Kaisha, Aichi, Japan

[21] Appl. No.: 122,765

[22] Filed: Nov. 19, 1987

[30] Foreign Application Priority Data

Nov. 21, 1986 [JP] Japan ..... 61-279434
Dec. 1, 1986 [JP] Japan ..... 61-286273

[51] Int. Cl.[4] ..... G06F 15/46

[52] U.S. Cl. ..... 364/470; 112/80.23; 112/121.12

[58] Field of Search ..... 364/470; 112/80.23, 112/121.11, 121.12, 103, 445

[56] References Cited

U.S. PATENT DOCUMENTS 4,429,364 1/1984 Maruyama et al. ..... 112/121.11
4,446,520 5/1984 Shigata et al. ..... 112/121.12
4,520,745 6/1985 Shinomiya et al. ..... 112/121.12
4,526,116 7/1985 Mannel ..... 112/121.12
4,622,907 11/1986 Kimura ..... 112/121.12
4,660,484 4/1987 Yasui ..... 112/121.12
4,768,450 9/1988 Kato et al. ..... 112/121.12

*Primary Examiner*—Allen MacDonald
*Attorney, Agent, or Firm*—Finnegan, Henderson, Farabow, Garrett, & Dunner

[57] ABSTRACT

A stitch data processing apparatus which can produce an embroidered pattern utilizing an automatic sewing machine from a pattern of any relative size. The pattern to be embroidered on a work piece is input to the stitch data processing apparatus via a charge coupled device. The charge coupled device produces an image which is displayed on a display device. An operator scales the image to fit onto the display device and then indicates points along the contour of the embroidered pattern and defines regions in which the automatic sewing machine will complete the embroidered pattern. The stitch data processing apparatus is capable of creating curved contours from a number of discreet points input by the operator. It is also possible to control stitch density.

8 Claims, 5 Drawing Sheets

STITCH DATA PROCESSING APPARATUS FOR EMBROIDERY SEWING MACHINE

BACKGROUND OF THE INVENTION

The present invention relates to a stitch data processing apparatus for an automatic sewing machine and more particularly to an apparatus for processing stitch data of complex embroidery patterns for use in an embroidery sewing machine.

There is a conventional method of processing stitch data for an automatic embroidery sewing machine, as disclosed in U.S. Pat. No. 4,520,745, the method comprising the steps of placing a sheet representing an original figure on a tablet board, specifying points on the contour lines of the original figure using a cursor, and detecting the position data of the points so as to process the stitch data. U.S. Pat. Nos. 4,429,364 and 4,446,520, though not intended for embroidery, also disclose methods similar to what is described in U.S. Pat. No. 4,520,745.

In the aforesaid methods, however, when like embroidery patterns but different in size are formed individually, an operator must specify the points on the contour lines using the cursor after processing an original figure for each size. Accordingly, there is a problem that the operation of specifying the points takes a rather long time.

U.S. Pat. No. 4,526,116 discloses a method of automatically processing stitch data by picking up an original embroidery picture drawn on a sheet by means of a television camera. However, this method still poses a problem in that, because the stitching order is automatically determined in this method, it is impossible to voluntarily set up the direction (seam direction), in which embroidery thread extends to form a pattern by satin stitches.

U.S. Pat. No. 4,660,484 also discloses a method comprising picking up the original embroidery picture using an optical scanner, storing the coordinate data thus obtained as pattern data, and adding data of stitching order to the pattern data. In this method, however, because the coordinate data obtained through the optical scanner is directly stored as the pattern data, accurate coordinate data can not be obtained in case that the original embroidery picture is an embroidery pattern to be formed on a workcloth. Moreover, in this method because only the same embroidery as the original embroidery picture can be formed, the original embroidery picture will have to be processed again when part of it is modified.

On the other hand, Japanese Patent Application Laid Open No. 75085/84 discloses a stitch data processing apparatus comprising an image sensor for reading the external shape of workcloth, an input tablet board, a stylus pen, and a CRT. In this stitch data processing apparatus, the external shape of the workcloth and the position specified by the stylus pen are displayed on the CRT and stitching data for carrying out stitching, along the external shape of the workcloth is processed through the stylus pen operated by an operator. However, the technique of making embroidery has not been taken into consideration in the method.

SUMMARY OF THE INVENTION

The present invention is intended to solve the aforesaid problems and it is therefore an object of the invention to provide a stitch data processing apparatus for an embroidery sewing machine, the apparatus being capable of processing any type of original embroidery pictures, of making it unnecessary to increase the size of the original picture proportionally when a larger embroidery pattern is required to be formed, of properly selecting the seam direction in accordance with the pattern and the like, and of readily inputting position data.

The stitch data processing apparatus for an embroidery sewing machine according to the present invention having stitch forming means including at least one needle for having a stitch; workpiece holding means for holding a workpiece; feed means for varying the relative position between the stitch forming means and the workpiece holding means; control means for controlling the feed means to form an embroidery pattern on the workpiece based on the stitch data indicating the relative position, the improvement wherein the stitch data processing apparatus comprises a carrier for carrying the original embroidery picture; reading means for reading the original embroidery picture carried by the carrier; image display means; original picture display control means for making the image display means display the original embroidery picture read out by the reading means; contour point input means for specifying the contour points along the figure of the original embroidery picture displayed by the image display means; contour line display control means for making the image display means display contour lines passing through the specified contour points; apex input means for dividing the area enclosed by the contour lines into a plurality of polygonal blocks and inputting the coordinates of the apexes of each block; density input means for inputting density for use in embroidering each block; means for processing stitch data on the basis of the coordinates of the apexes of the blocks and the density; and storage means for storing the stitch data thus processed by the processing means.

The original embroidery picture is read by the reading means and displayed by the image display means. When an operator specifies the contour points by operating the contour point input means while looking at the original embroidery picture displayed on the image display means, the contour line display control means displays the contour lines on the image display means. When the operator then divides the area enclosed by the contour lines into a plurality of polygonal blocks and inputs the coordinates of the apexes of each block using the apex input means, the processing means computes stitch data on the basis of the coordinates of the apexes and the density, whereas the storage means stores the stitch data.

DETAILED DESCRIPTION OF THE PREFERRED EMBODIMENTS

Referring now to FIGS. 1–9, an embodiment of the present invention will be described in detail.

Figure 1:
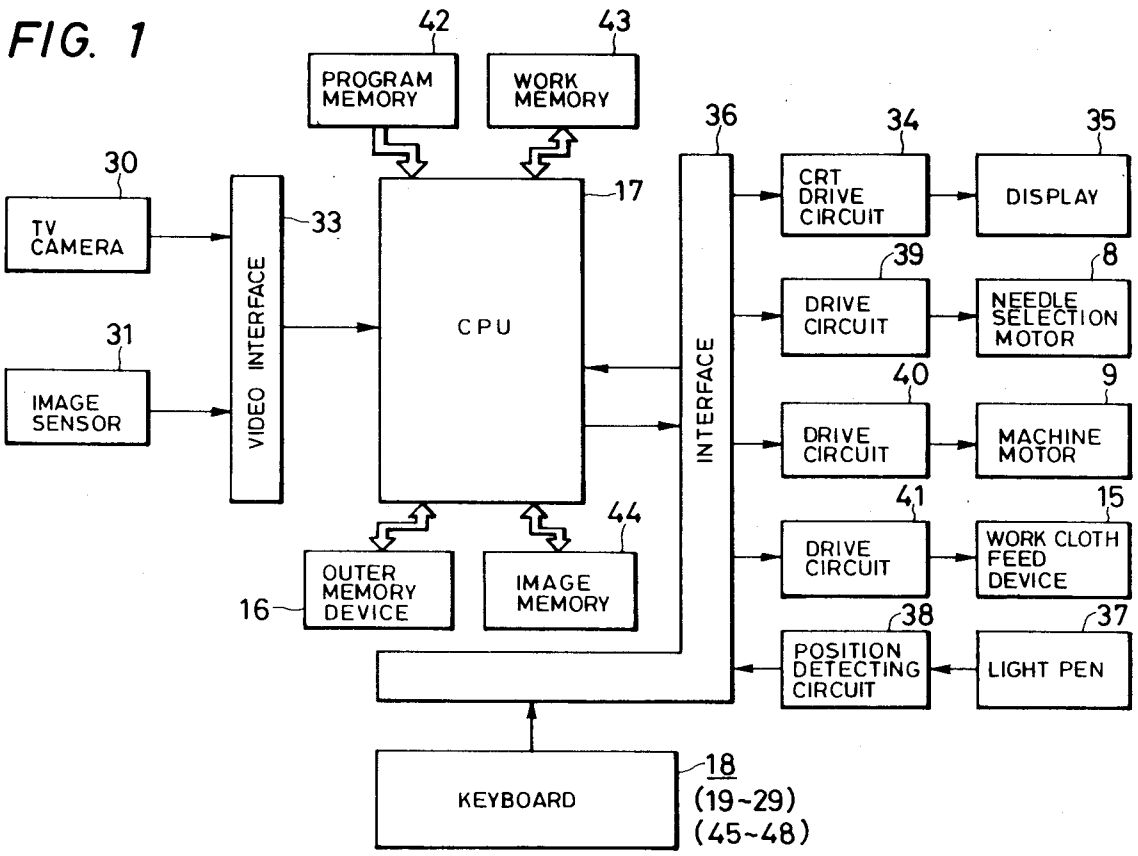
FIG. 1 is a block diagram of electric circuits of a multiple-needle embroidery sewing machine according to the present invention.
Figure 2:
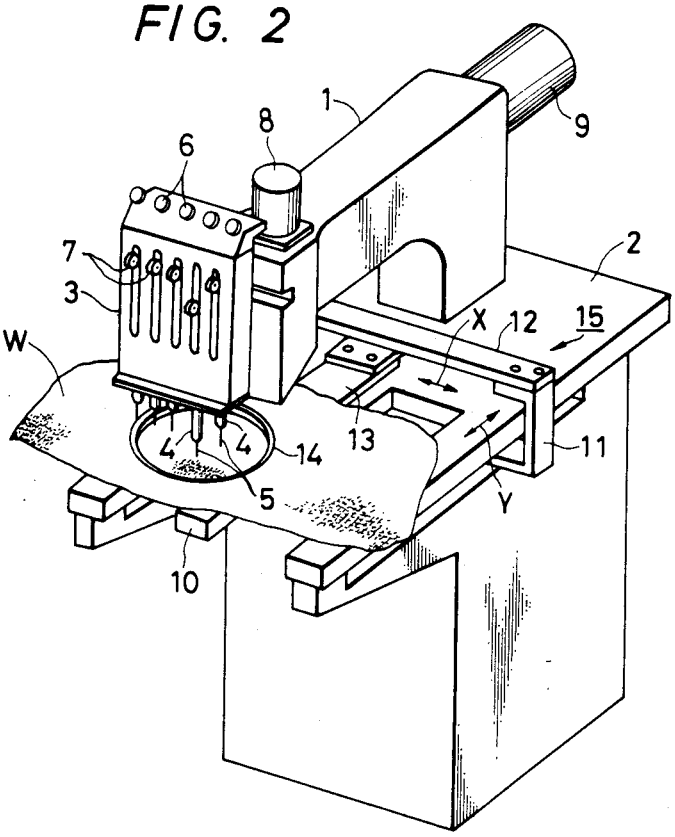
FIG. 2 is an overall perspective view of the multiple-needle embroidery sewing machine.
Figure 3:
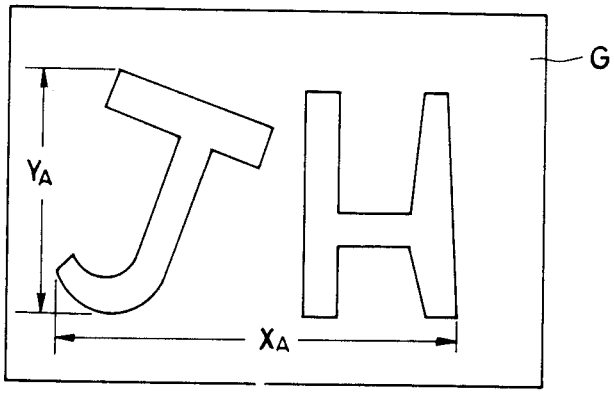
FIG. 3 is a diagram illustrating an image displayed on a display.

A machine arm 1 is disposed on a table 2 and a needle bar support case 3 is supported movably in direction of arrow X shown in FIG. 2 at the front end of the machine arm 1. Each of five needle bars 4 is supported in the support case 3 movably in the vertical direction and needles 5 are detachably secured to the lower ends of the needle bars 4, respectively. Different kinds of thread are applied from thread supply sources (not shown) via thread tension means 6 on the needle bar support case 3 and take-ups 7, respectively. A needle selection motor 8 is disposed on the machine arm 1 and coupled to the needle bar support case 3 for driving purposes. When a prescribed needle bar selection signal is applied to the needle selection motor 8, the needle selection motor 8 moves the needle bar support case 3 to selectively arrange one of the needles 5 at a predetermined operating position.

A machine motor 9 is located at the back of the machine arm 1 and, when its power is transmitted via a power transmission mechanism (not shown) in the machine arm 1 to the needle bar 4 at the operating position, the needle bar 4 is moved vertically. A machine bed 10 is projected from the table 2 opposite to the needle bar 4 set at the operating position and contains a loop taker (not shown) for forming a stitch on workcloth (workpiece) W in cooperation with the needle 5. The needle 5, the loop taker, etc. constitute stitch forming means.

A pair of Y-direction moving frames 11 (only one of them being shown) can reciprocate in the Y-direction along the lateral side edges of table 2 and are driven by a Y-direction drive motor (not shown). A support bar 12 is also installed to connect both the moving frames 11. The base end of an X-direction moving frame 13 is movable along the support bar 12 in the X-direction and driven by an X-direction drive motor (not shown). A workcloth holding frame 14 as workcloth holding means is fitted to the X-direction moving frame 13 to hold the workcloth W detachably.

The Y- and X-direction moving frames 11, 13, the support bar 12 and the Y- and X-direction drive motors constitute a workcloth feed device 15 as feed means for changing the relative position of the workcloth holding frame 14 to the needle 5 synchronously with the vertical movement of the needle 5. The movement of the workcloth holding frame 14 relative to the needle 5 allows the formation of a stitch pattern such as an embroidery on the workcloth W.

An electrical arrangement in the sewing machine will subsequently be described. An external storage device 16 as storage means consists of a magnetic disk and a disk drive, a plurality of pattern data such as stitch data is stored in the magnetic disk device. In this embodiment, the pattern data consist of a number of relative position data indicating the relative position of the needle 5 to the workcloth holding frame 14, i.e., coordinates Cn (n is integer) of needle drop positions (stitch points).

A central processing unit (CPU) 17 includes control means and operational means. A program memory 42 consists of a read only memory and stores various control programs for use in driving and controlling the machine and a display 35 consisting of a CRT as image display means. A work memory 43 consists of a memory capable of reading and writing data and is provided with areas where various kinds of data, the results of operations, etc. are temporarily stored at the time the stitch data are processed, or the stitch data from the external memory device 16 is stored.

There are provided various keys on an operating keyboard 18, including a contour setting mode key 19, a line mode key 20, a smoothing mode key 21, a smoothing mode termination key 22, a load key 23, a jog key 24, a correction mode key 25, a cancellation key 26, a consecutive contour line termination key 27, an image block termination key 28, a stitch data, processing mode key 29, etc. When each key is depressed, it send an ON signal to the CPU 17. The contour setting mode key 19 is used to set a contour mode, whereas the line mode key 20 is used to input the coordinates of contour points. When the line mode is set, the points are connected in the order in which they are inputted. The smoothing mode key 21 is used when a plurality of points specified are approximated with a smooth line, whereas the smoothing mode termination key 22 is used when the smoothing mode is terminated.

A television camera 30 as reading means for reading the original picture in a monochromatic monotone mode consists of CCD element called an area sensor and a control unit equipped with synchronizing and timing signal generating ICs attached to the former. An image sensor 31 as reading means for reading the original picture is also equipped with part CCD elements called a line sensor as a main part and synchronizing and timing signal generating ICs. Each of the reading means compares the image signal detected by the CCD element with an adjusted gray-color threshold, which depends on the hue, lightness or chroma saturation of the original picture pattern or the combination of them. The picture elements having gray-color values between black and white are classified into two groups having lighter and darker picture elements so as to convert these elements into binary values, which are supplied to the CPU 17 via a video interface 33.

When the original picture with various colors overlapped over one another and with no trim is read out, it is necessary to use a color filter corresponding to each color or select various hue setting values to obtain a desired image. This problem can be solved by applying a well known color printing technique of photoengraving method. Based on the image signal, the CPU 17 drives the display 35 via an interface 36 and a CRT drive circuit 34.

A light pen 37 is connected via a position detecting circuit 38 and the interface 36 to the CPU 17 and, when it is directed to a picture on the display 34, the position detecting circuit 38 detects the position coordinates (image coordinates) of the point specified, whereas the CPU 17 stores the image coordinates in an image memory 44. The image memory 44 stores the coordinates representing the positions of a group of points specified at the time when contour lines are specified and a group of points (turning points) at the time when the region enclosed by the contour lines are divided into blocks, together with lines (including curves) connecting these points on the picture plane. The data based on the image signals read by the television camera 30 or image sensor 31 is selectively displayed on the display 35 by means of an image switching key (not shown) provided on the operating keyboard 18.

Drive circuits 39, 40, 41 are connected via the interface 36 to the CPU 17 and control the needle selection motor 8, the machine motor 9 and the workpiece feed device 15 are controlled in accordance with the control signals from the CPU 17, respectively.

A description will further be given to data input for a satin stitch by means of the stitch data processing apparatus thus constructed.

A power source switch (not shown) is actuated to effect the CPU 17 of the stitch data processing apparatus. Subsequently, the original picture G is set so that the television camera 30 or image sensor 31 can pick it up and the image switching key is used to switch to the reading means presently taking the original picture in order that the image is displayed on the display 35 (the image taken by the television camera is displayed in this embodiment of the present invention). The original picture may be a photograph or a sample of the embroidery patterns sewn on workcloth.

In this example a pattern J 51 and another H 52 are displayed on the picture plane 35*a* of the display 35, the CPU 17 has a horizontal reference line 53 displayed on the picture plane 35*a* according to the control program when a reference line setting key (not shown) simultaneously used as an envelope line setting key of the keyboard 18 is turned on and when the light pen 37 is directed to any desired position (point A) on the picture plane 35*a*. The CPU 17 also arranges the height of the camera 30 and the relative position of the camera 30 and the original picture G by relative rotation or movement so that both the patterns 51 and 52 are contained within the set range on the picture plane 35*a* and the horizontal reference line 53 is coincident with the horizontal of the original picture G. Moreover, a seam pitch setting key 47 and number keys 48 as data input means on the operating keyboard 18 are operated so that the CPU 17 is informed of the seam pitch, whereas the CPU 17 stores the data in a predetermined storage area of a work memory 43.

Subsequently, the light pen 37 is directed to a point B located on the periphery of the pattern J or H on the picture plane 35*a* to display an X-direction envelope line corresponding to the X-direction of the workpiece feed device of the automatic machine. Points C, D are specified in the same manner as described above to display Y-direction envelope lines 55*a*, 55*b* corresponding to the Y-direction of the workpiece feed device 15 and the image displayed is converted into an enlarged one by operating an enlarging key (not shown) on the operating keyboard 18 so that at least one of the X- and Y-direction envelope lines coincides with the borderline 56*a* of an image display range 56. At this time, the conversion above should be preferably made under the condition that the X-direction rate of expansion equals to the Y-direction rate thereof, a point E on the left lower side of the image display range 56 coincides with a cross point F of the Y-direction envelope line 55*a* and the X-direction envelope line (horizontal reference line) 53, and the pattern is contained in the Y-direction range of the image display range 56 with the Y-direction length YA of the original picture pattern as a reference. At this time, the ratio of the picture elements on the display 35 to the size of the stitch pattern being formed and the stitch data is fixed and consequently the conversion rate is stored in a predetermined storage area of the work memory 43.

Assuming the Y-direction length YD of the image display range is displayed with 400 dots and the X-direction length XD thereof with 600 dots; on the other hand, the X-direction length XA of the pattern=100, whereas the Y-direction length YA thereof=80 mm.

One dot of the Y-direction image display range 56:

$$YA/400=80/400=0.2 \text{ mm}$$

i.e., the resolution is 0.2 mm and, if this 0.2 mm is applied to the X-direction, XA/XD1=0.2 (XD1 is the number of dots representing the length of the pattern enlarged).

Since XA=100

$$XD1=100/0.2=500$$

i.e., the X-direction pattern thus enlarged is displayed with 500 dots.

Figure 5:
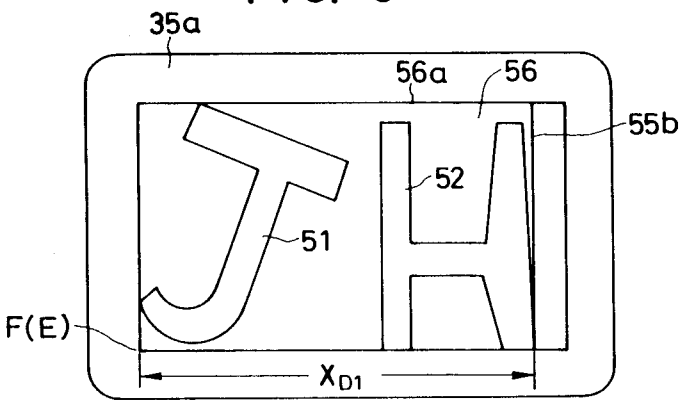
FIG. 5 is a diagram illustrating the enlarged image.
Figure 8:
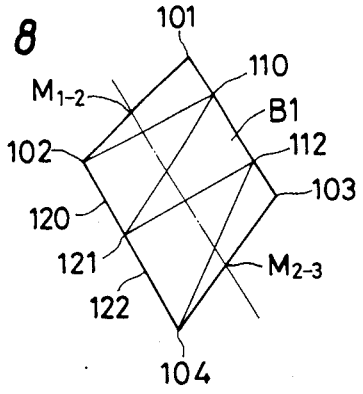
FIG. 8 is a diagram illustrating the principal part of FIG. 7.
Figure 9:
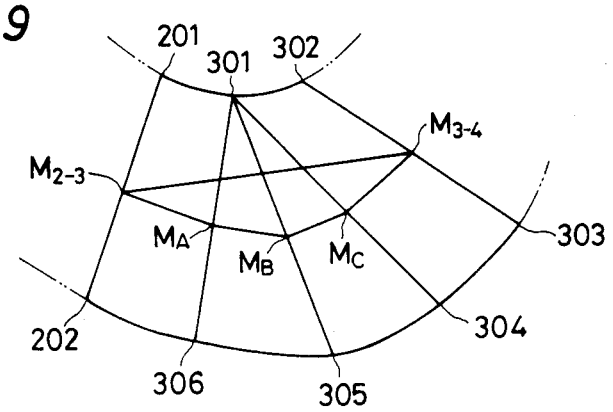
FIG. 9 is a diagram illustrating the enlarged block of FIG. 7.

For that reason, the Y-direction envelope line 55*b* remains as shown in FIG. 5. After being enlarged as desired, the Y-direction envelope line 55*b* is specified by the light pen 37 to erase it and, if the cancellation key 26 of the operating keyboard 18 is turned on, the CPU 17 erases the Y-direction envelope line 55*b* from the picture plane 35*a*. Sewn dimensions may be specified and entered via the keyboard, regardless of the dimensions of the original picture, and the XA dimension may be set as a reference, whereas because the X- and Y- direction ratios of conversion may needless to say be different from each other, the proceeding envelope line may be extended or contracted up to the whole image display range.

(1) Contour point data input

The step of inputting image contour points will subsequently be described.

The size of an embroidery pattern to be sewn according to the present embodiment is assumed to be integer times the minimum resolution of the workcloth feed device 15 and the coordinate system used in the present embodiment mainly consists of two kinds: an image coordinate system of the picture plate by dots and the stitch data coordinate system by the resolution of the clothwork feed device 15. On the other hand, as the numerical value employed in the CPU 17 during the operational processing, the position of a point on the display 35; i.e., the data input by the light pen 37 with the image coordinate system and subjected to conversion into an antilog coordinate system is used. The results of operations are respectively stored in the corresponding predetermined areas of the work memory 43, whereas they are stored in the external storage 16 with the antilog coordinate system when preserved as the stitch data.

The data of the antilog coordinate system is subjected to conversion into the image coordinate system when displayed on the display 35 and into the stitch data coordinate system when changed into the stitch data for use in stitch pattern formation by controlling the drive of the workcloth feed device 15. The coordinate conversions are carried out as occasion demands, but the following description hereinafter will not refer to such coordinate system conversions for the sake of convenience.

Figure 6:
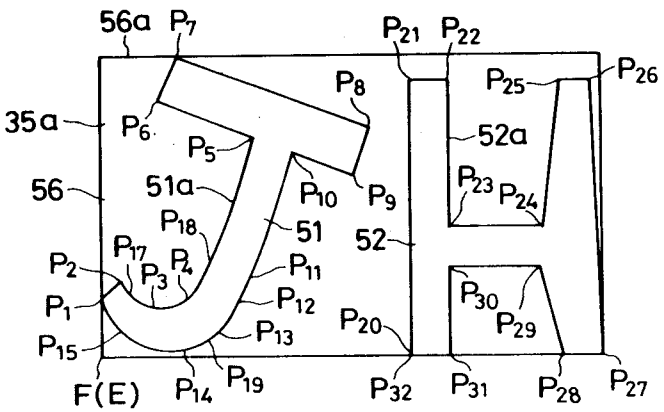
FIG. 6 is a diagram illustrating the contour points specified.

In FIG. 6, the worker turns on the contour setting mode key 19 to set the contour setting mode and uses the light pen 37 along the contour of the pattern J 51 displayed on the image plane 35*a* to successively input contour points P1 to P15. At this time, two modes are selected from the operating keyboard 18 according to circumstances.

Figure 4:
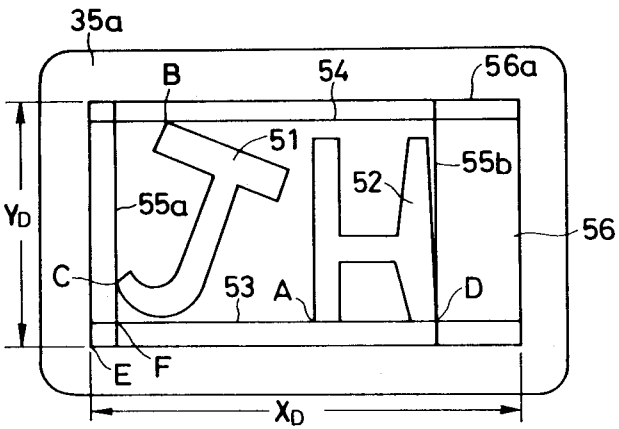
FIG. 4 is a diagram illustrating the envelope lines displayed on the display.

The line mode is first input via line mode key 20 to adopt the point F on the left lower side of the image display range 56 used in FIG. 4 as the reference point of this stitch pattern. Setting the reference point is automatically brings the relative needle position to that point F at the time of the termination of a stitch cycle. In this case, the point F may be equivalent to the start position of the stitch cycle or used as a reference point for determining the size of another pattern in the directions of X and Y when the pattern is combined with another seam pattern.

Then a point P1 is specified by the light pen 37 in reference to the image within the image display range 56 of the picture plane in combination with the decision of the operator. That input may be an edge point on the contour line of the image or may be spaced from the edge point thereof. According to the data specified by the light pen 37, the CPU 17 causes the point P1 thus specified to blink on the picture plane 35*a* of the display 35; if this point is located at the desired position, the load key 23 is operated to fix it (i.e., the blink display is replaced with a nonblink one).

As it is troublesome to specify points one by one, the newest input point is blinked first and the next point may be specified by the light pen 37. The CPU 17 automatically locks up the proceeding point P1 and blinks another input point subsequently. In the contour setting mode, the reference point (point F in this embodiment) and the point P1 initially specified are prevented from being connected with a straight line.

The line mode is then activated via the line mode key 20 on the keyboard 18. When a point P2 is similarly specified, the CPU 17 keeps the point P1 on the picture plane 35*a* lighted while blinking the point P2. While the point P2 is also kept lighting through the load key 23, the PCU 17 displays a contour line connecting both the points P1 and P2 with a straight line. The CPU 17 makes the work memory 43 store data for use in determining whether the two points are connected with a curve or straight line.

When it is required to connect points P2~P3~P4 on the picture plane 35*a* with a curve, the smoothing mode key 21 of the operating keyboard 18 is operated. The points P3, P4 are successively selected and specified with the light pen 37 in the smoothing mode and, after the point P4 is selectively specified, the smoothing mode termination key 22 is operated. The CPU 17 then displays a curve smoothly connecting the points, P2~P3~P4 and blinks the curve. In order to improve accuracy, it is preferred to specify more than one point between the points P3 and P2 and between the points P3 and P4.

In case the point P3 is unspecified, a semicircle with the distance between P2 and P4 as a diameter is formed on either left- or right-hand side with respect to the direction of P2→P4. When the curve connecting the blinking points P2~P3~P4 is not an intended one, the cancellation key 26 is operated to cause the CPU 17 to cancel the points P3, P4 excluding P2 according to the on-signal and also cancel the curve connecting them. Further, the smoothing mode key 21 of the operating keyboard 18 is again operated to newly input points P3, P4 in the same manner as described above.

When the intended curve is obtained, the line mode is actuated by depressing line mode key 20 on the keyboard to respectively connect points P4~P11 with straight lines and each point from P5 is successively selected and specified with the light pen 37 to respectively display the points P4~P11 connected with straight lines. The smoothing mode is subsequently keyboarded through the smoothing mode key 21 to respectively connect points P11~P15 with curves and each point from P12 is successively selected and specified with the light pen 37 to respectively display the points P11~P15 connected with curves.

In either state where the point 15 is blinking or kept lighted, the CPU 17 displays a blinking straight line connecting the points P15 and P1 when the consecutive contour line termination key 27 of the operating keyboard 18 is operated. When the points P12~P13~P14~P15 are selected and specified in the smoothing mode and when the one image block termination key 28 is operated before the smoothing mode termination key 22 is operated, the point P1 followed by the point P15 and already fixed is applied as a termination point for smoothing purposes. When the smoothing mode termination key 22 is operated at that time, the CPU 17 computes a curve smoothly connecting the points P12~P13~P14~P15~P1 as in the aforesaid case and displays it as a blinking curve. The CPU 17 thus displays the blinking straight line or curve connecting the points P15-P1 and, when the load key 23 is operated, then changes the blinking straight line or curve to those kept lighted.

Consequently, a contour line 51*a* is determined based on the pattern J 51 and the points P1~P15 thus selected, specified and fixed respectively become contour turning points (inflection and division points). When the contour points are specified, they are stored from the point F in the order in which they have been locked up in the predetermined areas of the work memory 43 in terms of coordinates (X, Y), the X, Y positions being stored as coordinate positions with the point F as an absolute origin.

With respect to a pattern H 52, the light pen 37 is used to select, specify and fix the contour points P20~P31 so that a contour line 52*a* is displayed. At this time, the coordinates of the contour points are stored in the predetermined storage areas of the work memory 43 successively as coordinate positions from the point F. When the position of the contour point thus adopted is not located as desired, the CPU 17 moves the contour point in any direction at a dot pitch in response to the key input if the jog key 24 of the keyboard 18 is operated while the point is blinked. If the contour point thus locked up is corrected, the following correction mode is adopted after the contour setting mode termination key (not shown) is operated.

(2) Correction mode

When the correction mode key 25 is operated, the CPU 17 sets the correction mode and, since the locked up contour points have been stored successively in the predetermined areas of the work memory 43 a contour point to be corrected is selected by inputting through the keyboard the number of steps through the numeral key 48. When the jog key 24 is subsequently operated, the CPU 17 moves the contour point on a dot basis in accordance with the keyboard input and blinks the point. At this time, the CPU 17 cancels the display of the straight line or curve connected to the contour point being corrected. When a lock-up key (not shown) on the operating keyboard 18 is operated further, the CPU 17 keeps the point lighted instead of blinking and locks it up and then reads from the work memory 43 line data for determining whether the straight line or curve connects the contour point to be corrected to the adjacent point. The CPU 17 computes the newly corrected contour point and what is adjacent thereto based on the line data and connects them with a straight line or curve.

When still another contour point is added between the contour points already locked up, an addition mode is activated through an addition mode key (not shown) on the operating keyboard 18 to cause the CPU 17 to set the addition mode. Subsequently, the light pen 37 is used to select and specify a pair of adjacent contour points thus locked up to specify the place between them which is used for the addition of a new contour point.

Subsequently, the line mode key 20 or smoothing mode key 21 select the mode in accordance with whether the additional contour point and one of the adjacent contour points (which has been specified earlier when the contour points were initially specified) are connected with a straight line or curve, and more than one of them are selected by the light pen 37. When the load key 23 is operated, the CPU 17 locks up the contour point thus added and computes the contour point added and selected one of the adjacent contour points in accordance with the selected mode, i.e., the line or smoothing mode, and connects them with a straight line or curve. The points P17, P18, P19 shown in FIG. 6 are those newly added.

(3) Stitch data processing (3-a) Line stitch data processing

Figure 7:
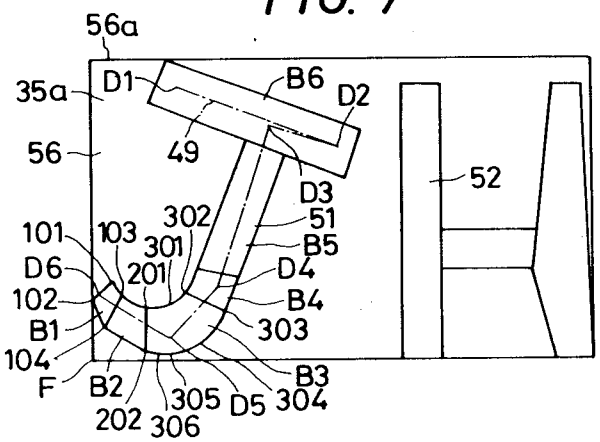
FIG. 7 is a diagram illustrating blocks.

Data input for making a J-stitched interlining seam 49 is carried out in the pattern J 51 as shown in FIG. 7 to let the seam have a puff when a satin stitch is made. More specifically, the CPU 17 blinks the point F as a data reference point (starting point) to show the relative position and provides a stitch data processing mode when the stitch data processing mode key 29 of the operating keyboard 18 is operated.

When a jump stitch mode key (not shown) is operated, the CPU 17 sets the jump stitch mode. Then the light pen 37 is employed to select and specify a stitch point D1 and, when a line stitch mode key (not shown) for implementing a straight stitch is operated, the CPU 17 sets the line stitch mode. If the same pitch of the J-stitched interlining seam 49 is set by the worker through the seam pitch setting key 45, the CPU 17 stores the seam pitch in the predetermined storage area. A stitch point D2 is subsequently similarly selected by the light pen 37.

The CPU 17 then converts the dot interval on the picture plane 35*a* into the distance covered by the workcloth feed device 15 of the automatic sewing machine using the aforesaid conversion rate and, according to the coordinate positions of both the stitch points D1, D2, computes the stitch direction of the workcloth feed device 15 and further stores the aforesaid distance and stitch direction data in the external storage 16.

As described above, the image coordinates of both the stitch points D1, D2 are converted into antilog coordinates and stored in the external storage 16. The antilog coordinates are read out at the time the stitch data is processed and, when they are converted into the stitch data coordinates, the stitch point Dn (n=1, 2, 3) specified on the picture plane 35*a* is formed into stitch data coordinates Cn. Given, for instance, the image coordinates of the point D1 are such that D1 (X, Y)=(40, 380) dots with the conversion ratio at 0.2, the stitch data coordinates of the point C1 becomes C1 (X, Y)=(8, 76) mm.

The CPU 17 makes computation so as to separate the points C1·C2 from each other in such a manner that the points C1·C2 in the stitch data coordinate system conform to the set stitch pitch when the stitch point D2 is specified, and displays the results of computation using the foresaid conversion ratio from the distance X, Y representing the seam per stitch starting with the point C1 as a row of points in the form of dots on the picture plane 35*a*. The relation of the display of the picture plane 35*a* using dots to the seam data (stitch data) shows that it has a threshold and, though the former does not strictly correspond to the latter for the purpose of selecting either dot, this allows the strict computation of the seam data at least. However, the aforesaid computation is leveled at the minimum resolution value of the drive data for the workcloth feed device 15 of the automatic sewing machine.

In that manner, the light pen 37 is successively used to select and lock up stitch points D3~D6 on the picture plane 35*a* so that the stitching data becomes framable. The line stitch data is thus processed.

(3-b) Stitch data processing on a block basis

A further description will subsequently be given to stitch data processing.

As shown in FIG. 7, each of the blocks B1~B6 is covered with a satin stitch in corresponding numerical order wherein the picture plane 35*a* should be divided units as many blocks as possible. The sewing thread density is set by the sewing thread density setting key 46 as data input means provided on the operating keyboard 18 (these values being kept in the work memory 43 unless reset, and used when required) and, after apexes 101, 102, 103, 104 are specified by the light pen 37 in order, they are input through the keyboard via load key 23. The apex specified then may be what is located on the contour line 51*a* or may be separated therefrom. In both cases, the CPU 17 judges that the point on the picture plane 35*a* designated by the light pen 37 has been selected and specified thereby.

The CPU 17 converts the image coordinates D101 (XD101, YD101) of the apex 101 into stitch data coordinates from the conversion ratio as follow:

$$C101(X, Y)=(XC101, YC101)$$

Thereafter, the CPU 17 computes the stitch data coordinates (XC102, YC102) of the apex 102; (XC103, YC103) of the apex 103; and (XC104, YC104) of the apex 104, reads out the sewing thread density N (N pieces of thread per 1 mm) from the work memory 43 and further computes the coordinates of an intermediate point $M_{1-2}$ between the apexes 101, 102 and those of $M_{2-3}$ between the apexes 103, 104 by the following equations:

$$C_{M1-2} \text{ of intermediate point} M_{1-2} = [X_{Ma}, Y_{Ma}] = [(X_{C101} + X_{C102})/2, (Y_{C101} + Y_{C102})/2]$$

$$C_{M2-3} \text{ of Intermediate point} M_{2-3} = [X_{Mb}, Y_{Mb}] =$$

-continued $$[(X_{C103}+X_{C104})/2,\ (Y_{C103}+Y_{C104})/2]$$

Subsequently, the intermediate points $M_{1-2}$ and $M_{2-3}$ are connected with a straight line and the distance therebetween $l_{B1}$ is computed:

$$l_{B1}=\sqrt{(X_{Ma}-X_{Mb})^2+(Y_{Ma}-Y_{Mb})^2}$$

The result thus obtained is multiplied by the sewing thread density N to obtain a dividing number m.

$$N\times l_{B1}=m$$

The CPU 17 divides the linear element connecting the apexes 101, 103 with the m to compute the coordinates of the dividing points 110, 111, 112. In the same manner, the CPU 17 divides the linear element connecting the apexes 102, 104 and computes the coordinates of dividing points 120, 121, 122. Based on the coordinates of each point, the CPU 17 computes the stitch data composed of the feed amount and stitch direction of the workcloth feed device 15 in the following order and stores the results of computation in the external storage 16.

Apexes 101→102→dividing point 110→121→112→apex 104.

Similarly, in case of the block B2, the sewing thread density setting key 46 is operated to specify the sewing thread density at a proper value again and then apexes 201, 202 are specified by the light pen 37. The CPU 17 computes those apexes likewise to process stitch data and stores the stitch data thus processed in the external storage 16.

The block B3 has two linear opposite sides and two remaining curved sides so that the smoothing mode is simultaneously employed. A zoom-up mechanism is also used for making the block readily understandable. Points of apexes 301~306 are selected and specified by the light pen, 37. Then a zoom-up command is input via operating keyboard 18 through a zoom-up key (not shown) to the CPU 17. Based on the command signal, the CPU 17 automatically creates a new conversion ratio and stores the ratio in the predetermined area of the work storage 43 and displays an enlarged block B3 in the image display range (see FIG. 9).

Further, the smoothing mode is input via operating keyboard 18 through the smoothing mode key 21 as in the case where the contour points of the apexes 201, 301, 302 on the picture plane 35*a* are specified, and then contour points are selectively specified by the light pen 37. The control program executed by the CPU 17 includes at least the secondary or greater functions of X, Y applicable in the smoothing mode:

$$f(X,\ Y)=A(X+aY+Ca)^n+B(X+bY+C_B)^{n-1}+\ldots+C$$

and, when three points are specified as described above, f(X, Y) at its cubic term and thereafter is set effective. The CPU 17 conforms the cubic equation by substituting the coordinates of the apexes C201, C301, C302 thus specified therein:

f(X, Y) C201, C301, C302

Subsequently, the smoothing mode is canceled by the smoothing mode termination key 22 once and the line mode is keyboarded through the line mode key 20 and then the apex 303 is selected and specified by the light pen 37. The smoothing mode is reset again and the points 304, 305, 306 and the apex 202 are specified by the light pen 37. In this case, f(X, Y) C304, C305, C306, C202 are obtained with f(X, Y) as a pentagonal function.

Because the operation of the cubic or greater equation normally takes a great deal of time for processing, it may be sufficient to determine the points 305 306, 202 through the cubic equation by determining 305, 306, 202 through the cubic equation as set forth above.

Subsequently, the intermediate points $M_{2-3}$ of the apexes 201, 202 and those $M_{3-4}$ of the apexes 302, 303 are obtained so that a dividing number m1 is obtained according to the distance between both the intermediate points and the sewing thread density N of the block 3. In order to increase accuracy, the intermediate point $M_A$, $M_B$, $M_C$ between the points 301·306; 301·305; and 301·304 are respectively computed to obtain the length l′ of a line connecting $M_{2-3}$—$M_A$—$M_B$—$M_C$—$M_{3-1}$, so that dividing number m2 may be computed with $N\times l'=m2$.

This m1 (or m2) is used to divide the aforesaid f(X, Y) C201, C301, C302 and f(X, Y) C304, C305, C306, C202 by m1 (or m2) to obtain each dividing point, which is successively (i.e., alternately) selected by the CPU 17 to process the stitch data which is stored in the external storage 16. When the aforesaid operation requires the setting of the smoothing mode and when the block is square, the stitch data is processed for the blocks B4~B6 as in the case of B1.

When the original pictures J, H are trimmed, it is possible to make conspicuous only the trimmings of the patterns J 51, H 52 on the image by changing the hue of the picture plane 35*a*. When no such trimmings exist, however, by referring the stratum of hue (change of the intensity) out of the contents of each picture element, i.e., each dot on the picture plane 35*a*, there may be employed such an automatic program that the horizontal or vertical direction is successively scanned, dots having the change of the stratum with more than some intensity are recognized as contour points, and the collection of such points is displayed, or that points on the contour line of the image, which are apparently recognized as edge points (turning points), are automatically displayed.

As described above, according to this embodiment, an image is enlarged or contracted to be expressed on the display 35, the contour line is determined while referring to the CRT display, the embroidery pattern expressed by the contour line is divided into a plurality of polygonal blocks, and stitch data are processed for each block.

In the aforesaid embodiment, the seam direction of the embroidery pattern thus formed is not constant. Accordingly, the following process is carried out to make constant the seam direction.

In the state in which the contour line has been determined as shown in FIG. 6, the operator operates the reference slit mode key 49 as setting means provided on the operating keyboard 18 to let the CPU 17 set the reference slit mode. The operator then sets the inclination ($\theta$) of the seam direction reference line (reference slit) (a clockwise angle from the horizontal direction on the picture plane 35*a*) using an angle setting key 50 to let the CPU 17 store the inclination ($\theta$) in the predetermined area of the work memory 43.

Figure 10:
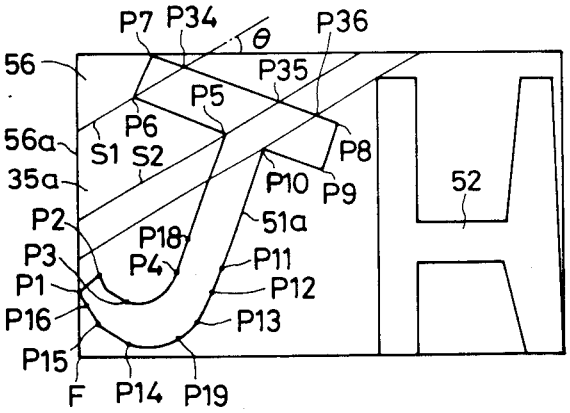
FIG. 10 is a diagram illustrating the displayed reference lines, FIG. 11 a diagram illustrating the blocks.

In the reference slit mode, the operator specifies any one point on the displayed contour line to display the reference line passing the specified point and having the inclination ($\theta$) on the picture plane 35*a*, and to carry out the process of obtaining an intersecting point of the thus displayed reference line and another contour line of the pattern. In other words, in FIG. 10, the CPU 17 displays the position coordinates of the point P6 and the seam direction reference line S1 passing the point P6 and having the inclination ($\theta$) within the image display range 56 when the point P6 is selected and specified by the light pen 37. Subsequently, the operator selects and specifies the points P7, P8 with the light pen 37 to obtain the contour point to be divided by the reference line S1. The CPU 17 then computes the coordinates of the intersecting point of the contour line connecting the points P7, P8 and the reference line S1, and displays the intersecting point P34 thus obtained in the image display range 56 with luminance different from what is employed for the display of the reference line S1.

At the same time, the point P5 is selected and specified by the light pen 37 and the reference line S2 passing the point P5 and having the inclination ($\theta$) is displayed. Subsequently, the points 7, 8 are selected and specified and an intersecting point of the contour line connecting the points P7, P8 and the reference line S2, the intersecting point P35 thus obtained being displayed in the image display range 56 with luminance different from that is employed for the display of the reference line S2. The same step as described above is carried out to display other intersecting points P36, P37, P38, P39, P40, P41, P42, P43 of reference lines Sn (n integer) respectively passing the contour points P10, P8, P10, P1, P16, P15, P14 and P4 of the contour line 51*a*.

Figure 11:
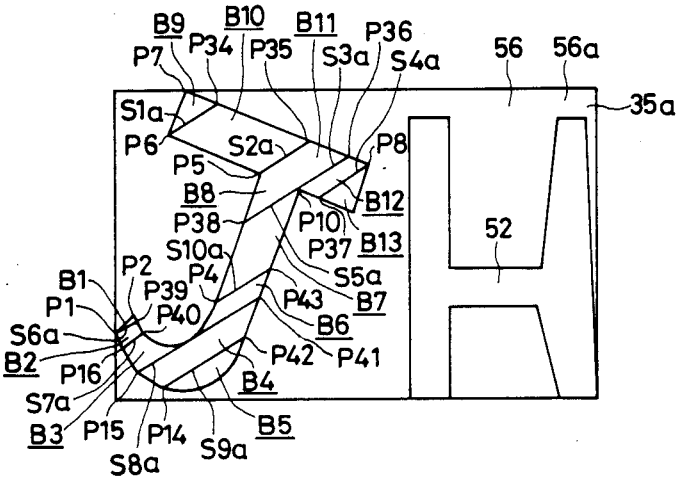

The CPU 17 obtains the position of each intersecting point through computation. When the intersecting point is displayed on the picture plane 35*a*, only the straight line (S1a~S10a) connecting the point specified by the light pen 37 and the intersecting point thus obtained are displayed and the remaining part of the reference line is erased at each time when the intersecting point is displayed. The inside of the contour lines is thus reduced to the blocks B1~B13 as shown in FIG. 11 in reference to the reference line. The operation of reducing the pattern to blocks is carried out in such a manner that each of the blocks B1~B13 can be regarded as square or triangular.

Figure 12:
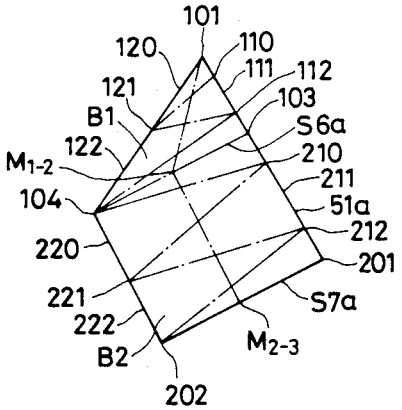
FIG. 12 is a diagram illustrating the principal part of FIG. 11.

As in the aforesaid embodiment in which the block is square, if the stitch data is processed for each block as set forth above, it is possible to form an embroidery pattern whose seam direction is constant as shown in FIG. 12. In the case of the block B1 (FIG. 12) which is triangular, the apexes 101, 102 (see FIG. 8) are treated as if they were identical.

The present invention is not limited to the aforesaid embodiments but applicable to automatically operated software for use in allowing an edge point to be automatically selected even though the operator selects and specifies the proximity of the edge point with the light pen 37 by, for instance, scanning the group of points recognized as the contour point from horizontal, vertical or both directions; treating such a point as an edge point that the point exists on the first scanning line and two or more points exist on the next scanning line in the proximity of the point, or otherwise two neighbouring points exist on a scanning line and the point exist on the following scanning line in the proximity of the points; and displaying the blinking point with the particular number of cycles or, in the case of particular color display, with particular colors in order to differentiate it from the group of points representing other contours.

Although the light pen 37 was employed in the aforesaid embodiments, it is also acceptable to use a mouse or tablet on the display 35 for input purposes. When the contour line is displayed, it may also be so arranged as to be separated from the contour point by means of blinking or color display, or otherwise any program for the purpose of conspicuously displaying the contour image line beforehand on the picture plane 35*a* of the display 35.

Although the aforesaid embodiment is arranged so that the stitch line is displayed according to the coordinates of the image, it is needless to say possible to employ the antilog coordinate system instead of the image coordinate system to display the sewing points, to add the image to the stitch data coordinate system as what is supposed to actually become a needle location point, or to display in such a manner that both displays can be alternately selected. Effect of the Invention As set forth above, according to the present invention, the original embroidery picture of any size can be dealt with and it makes unnecessary to enlarge the original picture even if a large embroidery pattern has to be formed corresponding thereto. Not only the patterns but also seam direction can be selected properly and made to suit what is required. Moreover, the operator is allowed to simply specify the data input corresponding to the pattern, thus effectively accelerating the data input.

What is claimed is:

1. A stitch data processing apparatus for an embroidery sewing machine having stitch forming means including at least one needle for forming a stitch;

workpiece holding means for holding a workpiece;

feed means for varying the relative position between said stitch forming means and said workpiece holding means; and control means for controlling said feed means to form an embroidery pattern on said workpiece based on the stitch data indicating the relative position, said stitch data processing apparatus comprising:

a carrier for carrying an original embroidery picture;

reading means for reading said original embroidery picture on said carrier;

image display means for displaying said original embroidery picture read by said reading means;

original picture display control means for controlling said image display means;

contour point input means for specifying contour points along the figure of said original embroidery picture displayed by said image display means;

contour line display control means for making said image display means display contour lines passing through said specified contour points;

apex input means for dividing the area enclosed by said contour lines into a plurality of polygonal blocks and inputting the coordinates of the apexes of each block;

density input means for inputting density for use in embroidering each block;

means for processing said stitch data on the basis of the coordinates of the apexes of said blocks and said density; and storage means for storing said stitch data thus processed by said processing means.

2. A stitch data processing apparatus for an embroidery sewing machine as claimed in claim 1, wherein said reading means includes means for selectively reading said original embroidery picture in the form of an enlarged version and a contracted version.

3. A stitch data processing apparatus for an embroidery sewing machine as claimed in claim 2, wherein said image display means includes a CRT, and said contour point input means and said apex input means include a light pen.

4. A stitch data processing apparatus for an embroidery sewing machine as claimed in claim 1, wherein said reading means includes a TV camera disposed against said carrier.

5. A stitch data processing apparatus for an embroidery sewing machine as claimed in claim 4, wherein said reading means includes means for selectively reading said original embroidery picture in the form of an enlarged version and a contracted version.

6. A stitch data processing apparatus for an embroidery sewing machine as claimed in claim 1, wherein said carrier includes a photograph.

7. A stitch data processing apparatus for an embroidery sewing machine as claimed in claim 1, wherein said original embroidery picture includes a stitch pattern formed on a workpiece.

8. A stitch data processing apparatus for an embroidery sewing machine having stitch forming means including at least one needle for forming a stitch;

workpiece holding means for holding a workpiece;

feed means for varying the relative position between said stitch forming means and said workpiece holding means; and control means for controlling said feed means to form an embroidery pattern on said workpiece based on the stitch data indicating the relative position, said stitch data processing apparatus comprising:

a carrier for carrying an original embroidery picture;

reading means for reading said original embroidery picture on said carrier;

image display means for displaying said original embroidery picture read by said reading mans;

original picture display control means for controlling said image display means;

contour point input means for specifying contour points along the figure of said original embroidery picture displayed by said image display means;

contour line display control means for making said image display means display contour lines passing through said specified contour points;

setting mans for setting a reference direction on said image display means;

reference line display means for making said image display means display a reference direction line extended in said direction set by said setting means;

apex input means for dividing the area enclosed by said contour lines into a plurality of polygonal blocks and inputting the coordinates of the apexes of each block;

density input means for inputting density for use in embroidering each block;

means for processing said stitch data on the basis of the coordinates of the apexes of said blocks and said density; and storage means for storing said stitch data thus processed by said processing means.

* * * * *